US008282404B1

(12) United States Patent
Little et al.

(10) Patent No.: US 8,282,404 B1
(45) Date of Patent: Oct. 9, 2012

(54) CARD CONNECTOR

(75) Inventors: Terrance F. Little, York, PA (US); Tod M. Harlan, Mechanicsburg, PA (US); Kuo-Chun Hsu, New Taipei (TW); Hsueh-Lung Hsiao, New Taipei (TW); Hung-Yang Yeh, New Taipei (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/168,928

(22) Filed: Jun. 24, 2011

(51) Int. Cl.
*H01R 13/658* (2011.01)

(52) U.S. Cl. .. 439/95; 439/928.1; 439/946; 439/607.22; 439/607.28

(58) Field of Classification Search ..... 439/92, 439/95, 101, 108, 607.22, 607.33, 607.28, 439/928.1, 946
See application file for complete search history.

(56) References Cited

U.S. PATENT DOCUMENTS

| | | | | |
|---|---|---|---|---|
| 6,089,882 | A * | 7/2000 | Costello | 439/95 |
| 7,338,324 | B2 * | 3/2008 | Hsiao et al. | 439/630 |
| 7,351,080 | B2 * | 4/2008 | Hsiao | 439/159 |
| 8,109,773 | B1 * | 2/2012 | Little et al. | 439/159 |
| 8,157,596 | B1 * | 4/2012 | Little et al. | 439/630 |
| 2007/0134959 | A1 * | 6/2007 | Hsiao | 439/159 |
| 2007/0134987 | A1 * | 6/2007 | Yen | 439/630 |

FOREIGN PATENT DOCUMENTS

| | | |
|---|---|---|
| TW | 335849 | 7/2008 |

* cited by examiner

*Primary Examiner* — James Harvey
(74) *Attorney, Agent, or Firm* — Wei Te Chung; Ming Chieh Chang

(57) ABSTRACT

A card connector includes a main housing having a base portion, a pair of side walls and a bottom wall connecting with the base portion and side walls thereby defining a receiving cavity. Multiple groups of contact sets comprise at least one grounding contact. The contact sets have contacting portions projecting into the receiving cavity. A metallic shell covers a top side of the main housing and defines an insertion opening together with the main housing. A pair of guiders are floatably assembled on opposite sides of the insertion opening for guiding different sized cards. A grounding plate which is attached to a bottom side of the main housing, comprises a pair of flexible tangs respectively pressing against a bottom side of the guiders. The grounding plate further comprises a grounding section electrically contacting with the at least one grounding contact so as to establish a grounding path.

13 Claims, 7 Drawing Sheets

CARD CONNECTOR

BACKGROUND OF THE INVENTION

1. Field of the Invention

The present invention relates to a card connector, and more particularly to an N-IN-1 card connector utilizing a metallic plate for establishing a grounding path.

2. Description of the Related Art

A card connector apparatus is generally used as an expanded recording apparatus of an electronic equipment such as a personal computer or a digital camera. As a storage medium of the card connector apparatus, a PC card or a memory card has come into wide use. This PC card or memory card is installed in the card connector apparatus to write and read necessary information. In recent years, as small memory cards, such as a long one, a short one, a thick one, or a thin one, have been developed, and various kinds of card connector apparatuses adapted for receiving multiple kinds of cards have been developed. An N-IN-1 card connector is usually adapted for receiving several kinds of cards therein, accordingly, the card connector arranged several kinds of contacts including grounding contacts for electrically contacting with the several kinds of cards. For preventing EMI during the signal transmitting, a grounding plate is often provided to electrically contact with grounding contacts. The grounding plate forms two spring plates for respectively contacting with the grounding contacts. Further, for guiding different sized cards, a pair of guiders are provided at an insertion port with support members respectively attached thereon. As there are numerous components within the card connector, the configuration of the card connector is complex and not easy for manufacturing. Obviously, an improved card connector is highly desired to overcome the aforementioned problem.

SUMMARY OF THE INVENTION

Accordingly, an object of the present invention is to provide a card connector with an improved grounding plate.

In order to achieve the object set forth, a card connector includes a main housing having a base portion, a pair of side walls extending forwardly from transverse ends of the base portion, and a bottom wall connecting with said base portion and side walls thereby defining a receiving cavity therebetween and extending along a rear-to-front direction. Multiple groups of contact sets comprise at least one grounding contact. Said contact sets have contacting portions projecting into the receiving cavity. A metallic shell covers a top side of the main housing and defines an insertion opening together with the main housing. A pair of guiders are floatably assembled on opposite sides of the insertion opening for guiding different sized cards. A grounding plate which is attached to a bottom side of the main housing, comprises a pair of flexible tangs respectively pressing against a bottom side of the guiders. The grounding plate further comprises a grounding section electrically contacting with the at least one grounding contact so as to establish a grounding path.

Other objects, advantages and novel features of the invention will become more apparent from the following detailed description of the present embodiment when taken in conjunction with the accompanying drawings.

DETAILED DESCRIPTION OF THE INVENTION

Figure 1:
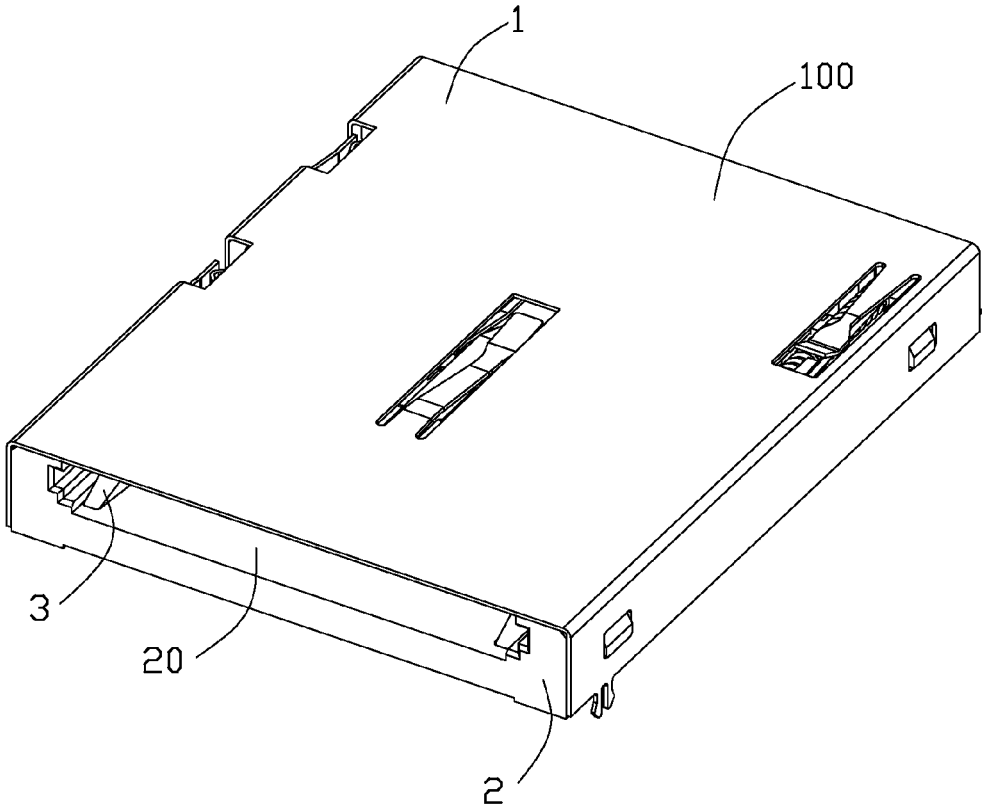
FIG. 1 is a perspective view of a card connector in accordance with the present invention.
Figure 2:
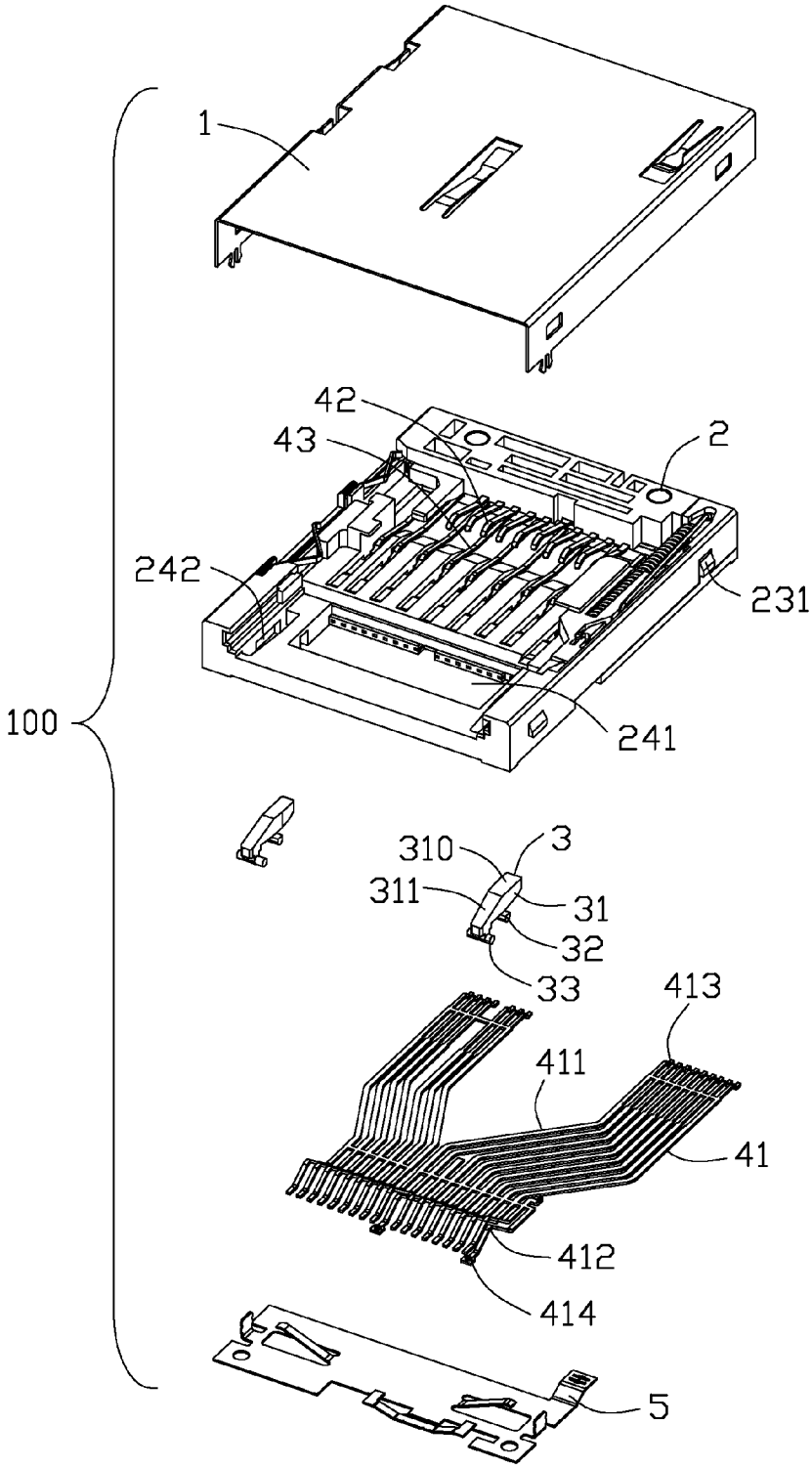
FIG. 2 is an exploded perspective view of the card connector shown in FIG. 1.
Figure 3:
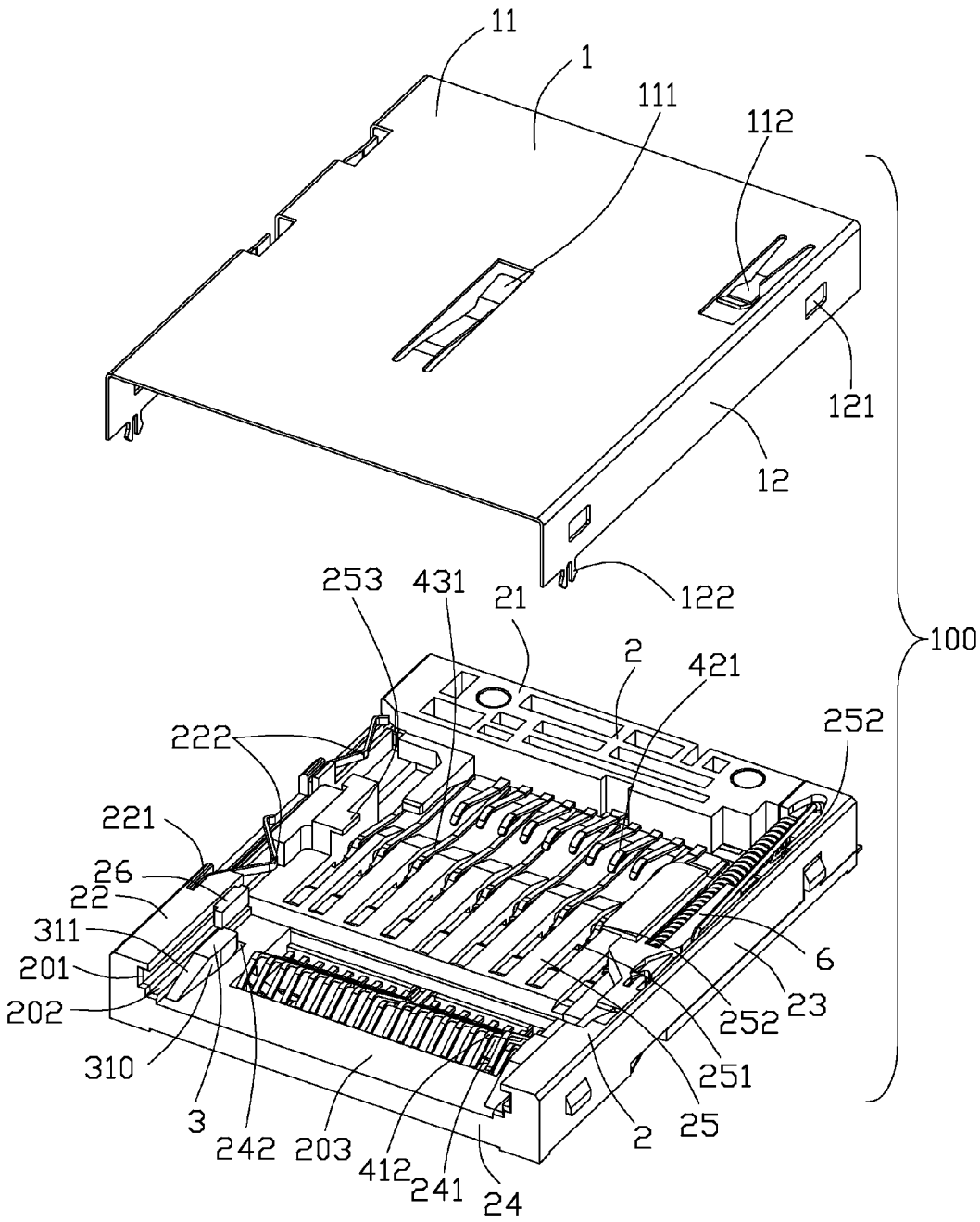
FIG. 3 is a partly exploded perspective view of the card connector shown in FIG. 1, which shows a detailed configuration inside the card connector.

Reference will now be made to the drawing figures to describe a preferred embodiment of the present invention in detail. Referring to FIGS. 1-3, a card connector 100 made according to the preferred embodiment of the present invention is provided and comprises a metallic shell 1, an insulative housing 2, a pair of guiders 3, a plurality of contacts 4 and a grounding plate 5.

The insulative housing 2 is configured as a rectangular shape and comprises a lengthwise base portion 21, a first side wall 22 and a second side wall 23 perpendicularly extending from two opposite ends of the base portion 21, and a bottom wall 24 extending forwardly from a lower side of the base portion 21 and connecting with the first and second side walls 22, 23. The metallic shell 1 covers an upper side of the base portion 21 and defines a card receiving cavity 20 between the metallic shell 1 and the insulative housing 2. The first side wall 22 defines a first passageway 221 extending along a rear-to-front direction for receiving a pair of switch contacts 222 therein. The second side wall 23 also defines a second passageway 232 extending along the rear-to-front direction for receiving an ejecting mechanism 6 therein. Detail description of the ejecting mechanism 6 will be omitted here as the ejecting mechanism 6 is configured as a normal type structure.

An elongated recess 241 is defined on the bottom wall 24 adjacent to a front opening of the receiving cavity 20 and extends along a transverse direction perpendicular to the rear-to-front direction. A pair of slots 242 are defined on the bottom wall 24 and located at two transverse ends of the elongated recess 241. The slots 242 run through the bottom wall 24 along a vertical direction perpendicular to the rear-to-front direction and transverse direction. A sliding plate 25 is formed behind the elongated recess 241. The sliding plate 25 is in a rectangular shape and defines a plurality of terminal grooves 251 staggered with each other along the transverse direction and extending along the rear-to-front direction. Each terminal groove 251 forms a shaft 252 therein and extending along the transverse direction. A stopper 253 extends upwardly from a left side of the sliding plate 25 and projects into the receiving cavity 20 inwardly for engaging with a front edge of a card.

The contacts 4 comprise a first contacts set 41, a second contacts set 42 and a third contacts set 43 respectively arranged at different rows and located at different positions of the receiving cavity 20 along the rear-to-front direction. The first contacts set 41 comprises a plurality of first contacts insert-molded in the bottom wall 24, of which at least two contacts are defined as grounding contacts. Each grounding contact comprises an elongated body portion 411, a solder portion 413 at one end of the body portion 411, a first contacting portion 412 extending from the other end of the body portion 411 and forming a curved configuration, and a joint portion 414 extending from a distal end of the first contacting portion 412. The first contacting portion 412 projects into the receiving cavity 20 through the elongated recess 241. The second and third contact sets 42, 43 are insert-molded in the base portion 21 with second and third contacting portions 421, 431 respectively projecting forwardly along the rear-to-front direction. The second contacting portions 421 are closer to the elongated recess 241 while the third contacting portions 431 are far away from the elongated recess 241.

Figure 4:
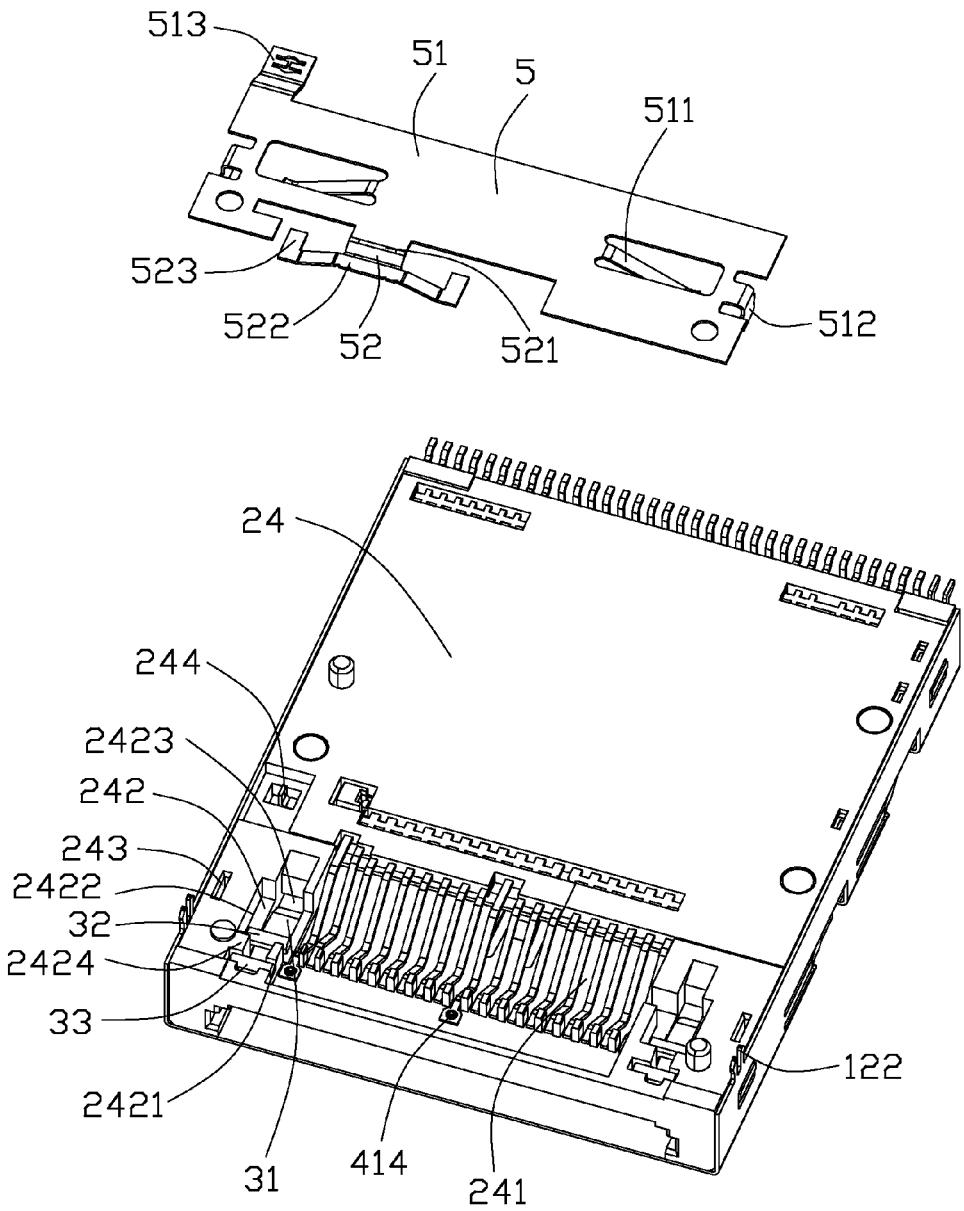
FIG. 4 is another partly exploded perspective view of the card connector shown in FIG. 1, seen from a bottom side.
Figure 5:
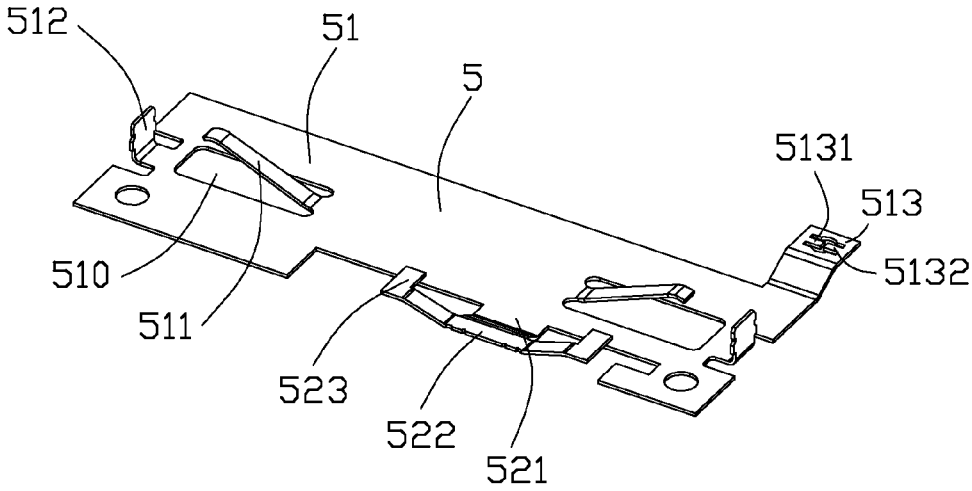
FIG. 5 is a perspective view of a grounding plate.
Figure 6:
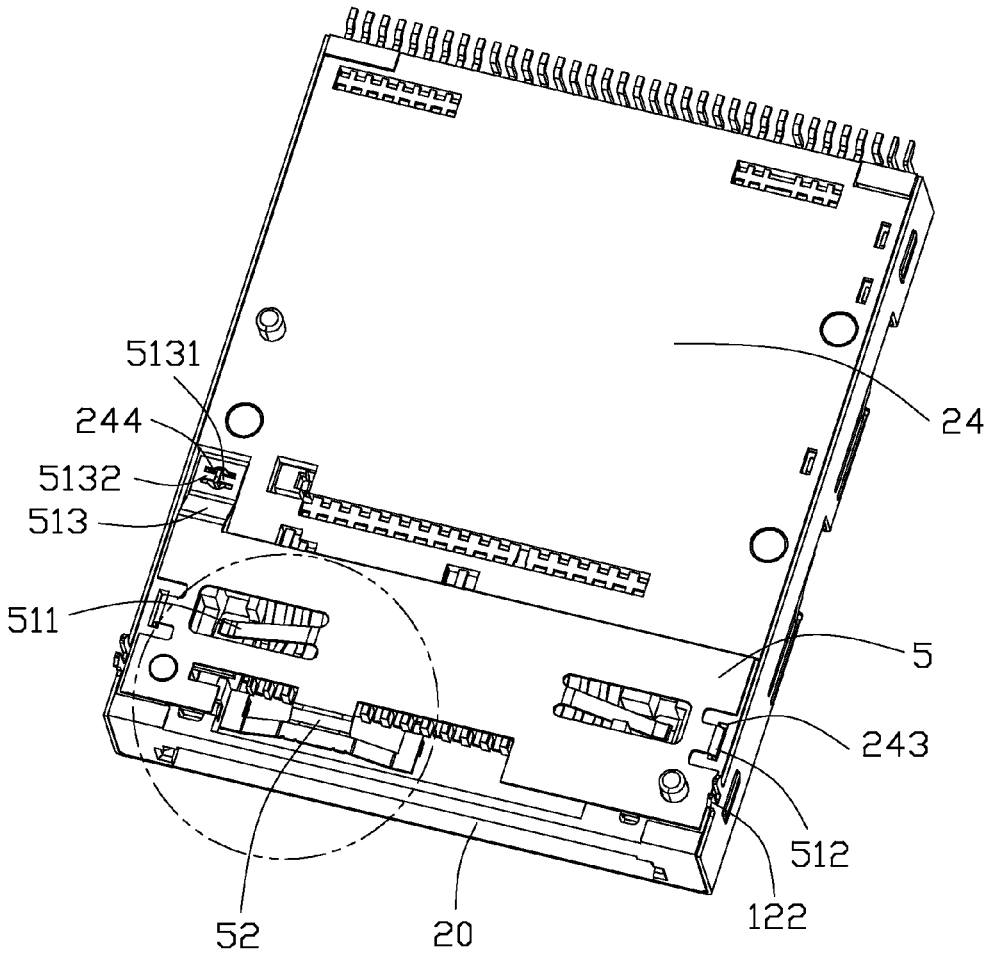
FIG. 6 is another perspective view of the card connector shown in FIG. 1, seen from a bottom side.
Figure 7:
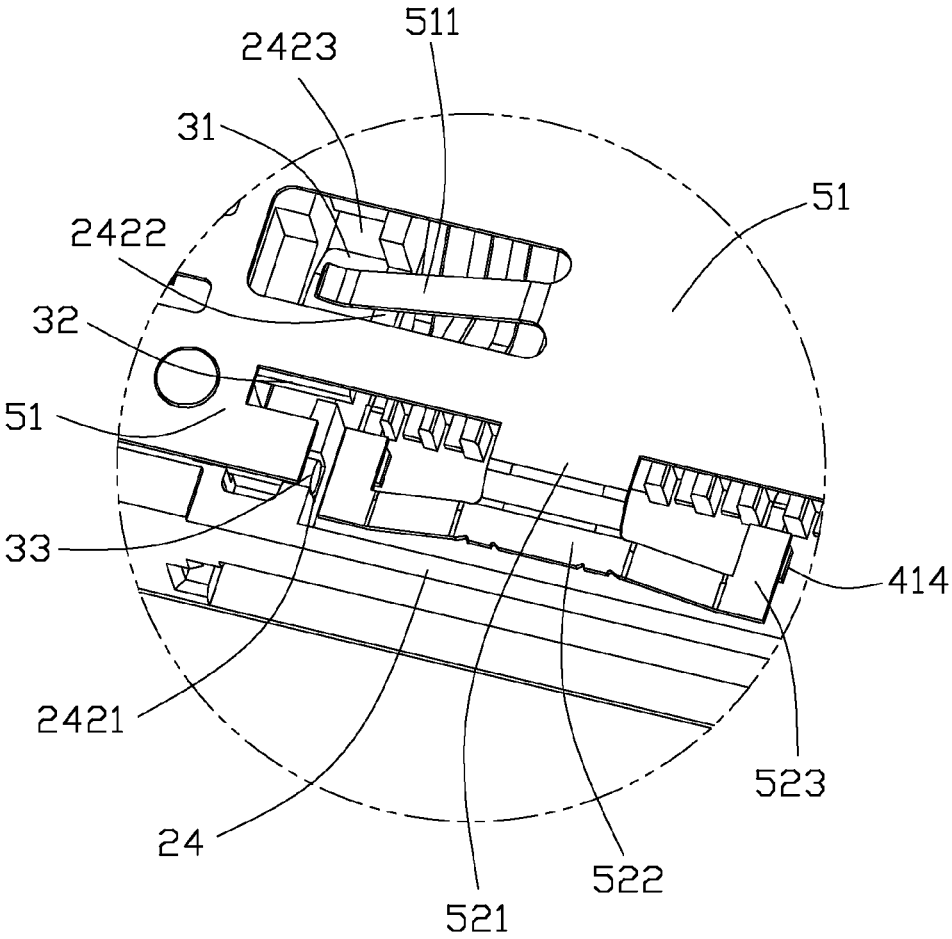
FIG. 7 is a partly amplified perspective view of the card connector taken from FIG. 6.

Referring to FIG. 2 to FIG. 4, the pair of guiders 3 are made by insulative material and each comprises an elongated body portion 31, a first rib 32 and a second rib 33 respectively formed at a bottom side of the body portion 31. The body portion 31 defines a horizontal supporting face 310 and a slant guiding face 311 extending from the supporting face 310. The slot 242 comprises a vertical slot 2423 extending along the vertical direction, a first horizontal slot 2421 and a second horizontal slot 2422 running across the vertical slot 2423 along the transverse direction. Further, a pair of partition sections 2424 are formed at two sides of the vertical slot 2423 and separate the first horizontal slot 2421 from the second horizontal slot 2422. The guiders 3 are inserted into the slots 242 from a bottom side thereof, with the first and second ribs 32, 33 respectively received in the first and second horizontal slots 2421, 2422, and the body portion 31 received in the vertical slot 2423 and projecting into the receiving cavity 20.

A first card receiving space 201 with a widest width is defined between inner sides of the first and second side walls 22, 23 for receiving a first card. A pair of blocks 26 are formed on the first side wall 22 for stopping the first card and allows the first card to electrically contact with the first contacting portions 412. A second card receiving space 202 is defined between the first and second side walls 22, 23 for receiving a second card to electrically contact with the third contacting portions 431. The second card will engage with the stopper 253 to push the sliding plate 25 to move rearward, meanwhile the shafts 252 urge the third contacting portions 431 to move upwardly to electrically contact with the second card. A third card receiving space 203 is defined between the pair of guiders 3 for receiving a third card to electrically contact with the second contacting portions 421.

Referring to FIG. 3, the metallic shell 1 is covered on the insulative housing 2 so as to form the receiving cavity 20 therebetween. The metallic shell 1 comprises a top cover 11 and a pair of skirts 12 extending downwardly from the top cover 11 and attached to the first and second side walls 22, 23. A first resilient arm 111 and a second resilient arm 112 are respectively formed on the top cover 11 and project into the receiving cavity. A pair of openings 121 are defined on the skirt 12 for receiving protrusions 231 formed on the second side wall 23. Further, a pair of board locks 122 are respectively formed on a lower edge of the skirts 12 for mounting onto a printed circuit board, on which the card connector 100 is seated.

Referring to FIG. 4 to FIG. 7, the grounding plate 5 is made by stamping and bending a metal sheet. The grounding plate 5 comprises a rectangular base plate 51 and a grounding section 52 extending from a longitudinal edge of the base plate 51. A pair of holding sections 512 are respectively formed on two lateral sides of the base plate 51 and extend perpendicular to the base plate 51. A pair of openings 510 are defined on the base plate 51, and a pair of tangs 511 respectively extend from adjacent ends of the openings 510 and project upwardly. A joint plate 513 extends rearward from a corner of the base plate 51, on which a pair of buckling plates 5132 are formed with an interval 5131 defined therebetween. The grounding section 52 comprises a connecting portion 521 connecting with the longitudinal edge of the base plate 51 and configured as a curved shape, an extending portion 522 extending along the transverse direction and a pair of wings 523 slantwise extending downwardly from opposite ends of the extending portion 522 respectively.

The grounding plate 5 is assembled onto the bottom wall 24 and shields the first contacts set 41. The holding sections 512 are inserted into apertures 243 defined on transverse ends of the bottom wall 24 so as to maintain the grounding plate 5 on the insulative housing 2. The joint plate 513 is located at a lateral side of the bottom wall 24. A bending plate 244 protrudes upwardly from the bottom wall 24 and inserts into the interval 5131 to buckle with the buckling plates 5132. The tangs 511 project upwardly to press against the body portion 31 of the guiders 3 through the second horizontal slot 2422, which can support the guiders 3 and prevent the guiders 3 from dropping off the slots 242. When the guiders 3 are pressed by the inserted second card, the tangs 511 move downwardly due to own flexibilities so as to provide space for movement of the guiders 3. When the inserted second card is drawn out, the tangs 511 will recover to the initial position and continue to support the guiders 3. Meanwhile, the pair of wings 523 of the grounding section 52 deflectably press against the bottom wall 24 and contact with the joint portion 414 of the grounding contact 41 so as to establish a grounding path. The joint portion 414 and the wings 523 of the grounding section 52 can be connected by a manner of soldering or others the like.

In the present invention, the grounding plate 5 can not only cooperate with the guiders 3 to lift the upward or downward movement of the guiders 3, but also can electrically contact with the grounding section 52 to establish a grounding path, which makes the card connector 100 more compact and multifunctional.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card connector comprising:

a main housing having a base portion, a pair of side walls extending forwardly from transverse ends of the base portion, and a bottom wall connecting with said base portion and side walls thereby defining a receiving cavity therebetween and extending along a rear-to-front direction;

a multiple groups of contact sets, comprising at least one grounding contact, said contact sets comprising contacting portions projecting into the receiving cavity;

a metallic shell covering a top side of the main housing and defining an insertion opening together with the main housing;

a pair of guiders floatably assembled on opposite sides of the insertion opening for guiding different sized cards; and a grounding plate attached to a bottom side of the main housing, comprising a pair of flexible tangs respectively pressing against a bottom side of the guiders;

wherein the grounding plate further comprises a grounding section electrically contacting with the at least one grounding contact so as to establish a grounding path.

2. The card connector as described in claim 1, wherein the grounding plate forms a pair of holding sections at opposite transverse sides thereof for being fixed in a pair of apertures defined on the bottom wall.

3. The card connector as described in claim 1, wherein a pair of slots running through the bottom wall are defined at opposite sides of the insertion opening for receiving said guiders, thereby said guiders could move upwardly or downwardly along a vertical direction perpendicular to the rear-to-front direction.

4. The card connector as described in claim 3, wherein each guider comprises a body portion, a first and a second ribs at a bottom side thereof, the first and second ribs abut against two sides of the slot and is shielded by the grounding plate, while the body portion projects into the receiving cavity.

5. The card connector as described in claim 1, wherein a first card receiving space is defined between the pair of guiders for receiving a first card, while a second card receiving space is defined between the pair of side walls for receiving a second card, the guiders will be pressed to move downwardly when the second card is inserted into the second card receiving space.

6. The card connector as described in claim 1, wherein the grounding section comprises a pair of wings respectively projecting beyond a base plate of the grounding section for electrically contacting with said grounding contact.

7. The card connector as described in claim 6, wherein the grounding contact comprises a joint portion exposed at the bottom side of the bottom wall and soldered with said wings.

8. The card connector as described in claim 1, wherein the metallic shell forms a top cover and a pair of skirts at opposite sides thereof, each skirt forms a board lock protruding downwardly for mounting onto a printed circuit board on which the card connector is seated.

9. A card connector assembly comprising:

an insulative housing defining a card receiving cavity;

a metallic shell attached to the housing;

a plurality of contacts disposed in the housing, and including signal contacts and grounding contacts;

a pair of guiders floatably assembled to the housing around a front insertion opening for selecting different type cards; and a grounding plate assembled to at least one of said shell and the housing; wherein said grounding plate not only mechanically and electrically connects to the grounding contacts but also includes tangs to supportably control the pair of guiders.

10. The card connector assembly as claimed in claim 9, wherein the pair of guiders are moveable in a vertical direction, and the tangs are moveable in the vertical direction correspondingly.

11. The card connector assembly as claimed in claim 9, further including an ejection mechanism for rejecting an inserted card.

12. The card connector assembly as claimed in claim 9, wherein the grounding plate is assembled to the housing.

13. The card connector assembly as claimed in claim 9, wherein the grounding plate is assembled to a bottom face of the housing.

* * * * *